US005689760A

United States Patent [19]

Suzuki et al.

[11] Patent Number: 5,689,760

[45] Date of Patent: Nov. 18, 1997

[54] IMAGE FORMING APPARATUS HAVING A FIXING SPEED AND A MOVEMENT SPEED OF THE RECORDING MEDIUM VARIABLY SYNCHRONIZED IN ACCORDANCE WITH A TYPE OF RECORDING MEDIUM

[75] Inventors: Akio Suzuki, Tokyo; Masanori Muramatsu, Yokohama, both of Japan

[73] Assignee: Canon Kabushiki Kaisha, Tokyo, Japan

[21] Appl. No.: 681,497

[22] Filed: Jul. 23, 1996

Related U.S. Application Data

[63] Continuation of Ser. No. 363,896, Dec. 27, 1994, abandoned.

[30] Foreign Application Priority Data

Dec. 27, 1993 [JP] Japan ..... 5-330230

[51] Int. Cl.[6] ..... G03G 15/14; G03G 15/20

[52] U.S. Cl. ..... 399/45; 399/66; 399/67; 399/298

[58] Field of Search ..... 399/45, 66, 67, 399/297, 320, 298

[56] References Cited

U.S. PATENT DOCUMENTS

| | | | |
|---|---|---|---|
| 4,593,992 | 6/1986 | Yoshinaga . | |
| 5,075,732 | 12/1991 | Menjo | 355/271 X |
| 5,160,970 | 11/1992 | Isogai | 355/282 X |
| 5,249,024 | 9/1993 | Menjo | 355/271 X |
| 5,260,751 | 11/1993 | Inomata | 355/271 |
| 5,333,038 | 7/1994 | Mizoguchi | 355/282 X |
| 5,374,983 | 12/1994 | Isogai | 355/284 |
| 5,424,819 | 6/1995 | Menjo | 355/284 |

*Primary Examiner*—R. L. Moses

*Attorney, Agent, or Firm*—Fitzpatrick, Cella, Harper & Scinto

[57] ABSTRACT

While a holding unit to hold a recording material is rotated at a first rotational speed, an image is recorded on the recording material held. The image on the recording material is fixed by a fixing unit. A fixing speed of the image formed is changed in accordance with the recording material such as normal paper, thick paper, OHP sheet, or the like. In an image forming apparatus according to the invention, after the image was recorded to the recording material on the holding means which is rotated at the first rotational speed, the rotational speed of the holding means is changed to a rotational speed corresponding to a fixing speed. After that, the recording material is separated from the holding unit and is conveyed to a fixing unit which is provided near the holding unit.

30 Claims, 12 Drawing Sheets

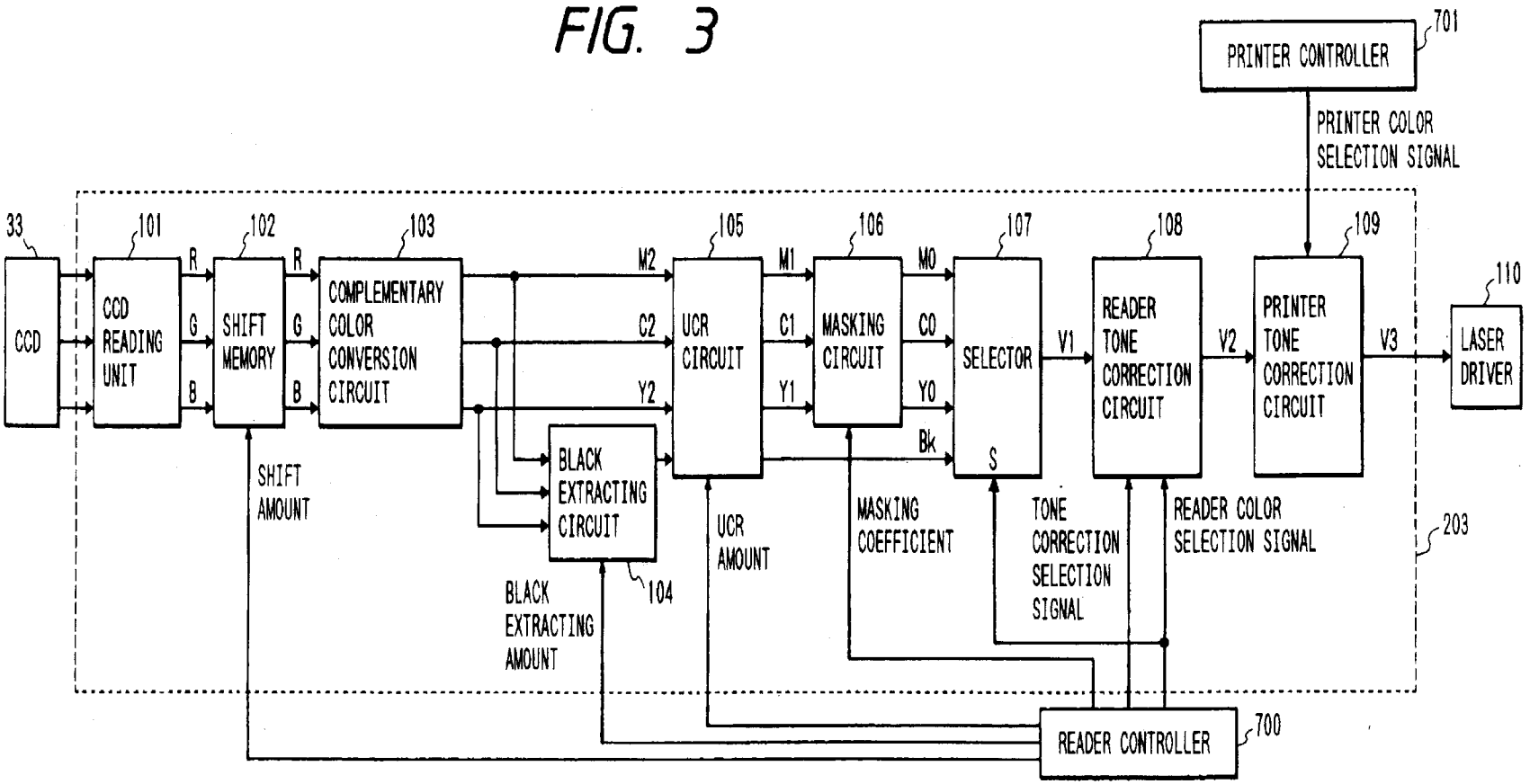
FIG. 3
33
CCD
101
CCD READING UNIT
R
G
B
102
SHIFT MEMORY
R
G
B
103
COMPLEMENTARY COLOR CONVERSION CIRCUIT
M2
C2
Y2
105
UCR CIRCUIT
M1
C1
Y1
106
MASKING CIRCUIT
M0
C0
Y0
Bk
107
SELECTOR
S
V1
108
READER TONE CORRECTION CIRCUIT
V2
109
PRINTER TONE CORRECTION CIRCUIT
V3
110
LASER DRIVER
104
BLACK EXTRACTING CIRCUIT
SHIFT AMOUNT
UCR AMOUNT
MASKING COEFFICIENT
TONE CORRECTION SELECTION SIGNAL
BLACK EXTRACTING AMOUNT
READER COLOR SELECTION SIGNAL
PRINTER COLOR SELECTION SIGNAL
203
700
READER CONTROLLER
701
PRINTER CONTROLLER

IMAGE FORMING APPARATUS HAVING A FIXING SPEED AND A MOVEMENT SPEED OF THE RECORDING MEDIUM VARIABLY SYNCHRONIZED IN ACCORDANCE WITH A TYPE OF RECORDING MEDIUM

This application is a continuation of application Ser. No. 08/363,896, filed Dec. 27, 1994, now abandoned.

BACKGROUND OF THE INVENTION

1. Field of the Invention

The invention relates to an image forming apparatus and, more particularly, to an image forming apparatus which can be applied to a color copying apparatus and a color printer.

More particularly, the invention relates to an image forming apparatus having recording material holding means such as a transfer drum for holding a recording material and to a control method which is used for such an apparatus.

2. Related Background Art

In a color image forming apparatus, a method of forming an image by changing image forming conditions in accordance with the kind of recording material is considered. For example, in case of a paper for OHP in which transparency of the formed image is important, there is a method of performing a fixing operation at a low fixing speed different from that of a normal paper in order to assure transparency. "Fixing speed" which is used here denotes a conveying speed of a recording material which passes through a fixing unit.

In association with the spread of color image forming apparatuses in recent years, it is demanded to form an image onto a paper such as a thick paper other than the OHP paper at a slow fixing speed and thereby to improve an image quality.

However, in order to fix the image at a fixing speed different from the image formation operating speed of a latent image, a development, or the like, a speed converting region to absorb a difference between both of those speeds. As a speed converting region, by using a paper conveying section from an image transfer apparatus to a fixing apparatus, the difference between the image formation operating speed and the fixing speed is absorbed.

Namely, in order to copy transfer a toner image formed on a photosensitive drum onto a recording material, the recording material has to be allowed to pass through the transfer position at a predetermined speed.

It is necessary to construct in a manner such that after the rear edge of the recording material passed through the transfer position at the predetermined speed, the speed of the recording material is changed and after completion of the speed change, the front edge of the recording material reaches the fixing position.

For this purpose, a length of path which is obtained by adding a length necessary for the speed change to the length of the recording material of the maximum length which can be used in the apparatus is needed between the transfer position and the fixing position.

The above apparatus has the following drawback such that when a size of whole apparatus having the paper conveying section is intended to be suppressed within a predetermined size, the size of recording paper (recording material) itself has to be limited.

Or, in the case where the limitation of the paper size as mentioned above is not performed, there is a drawback such that the apparatus increases in size.

SUMMARY OF THE INVENTION

In consideration of the above drawbacks, it is an object of the invention to provide an image forming apparatus which can realize a mode for performing a fixing operation at a fixing speed different from an image formation speed in a thick paper mode or the like without an increase in size of the apparatus and a limitation of an image formation size.

To accomplish the above object, according to the invention, there is provided an image forming apparatus comprising: recording material holding means for holding a recording material to record image information; fixing speed switching means for setting a fixing speed of the recording material; and separating means for separating the recording material from the recording material holding means at a speed corresponding to the set fixing speed. The separating means controls a speed at the time of separation in the recording material holding means.

It is also possible to perform the following controls. (1) The separation timing at the time of the separation in the recording material holding means is controlled in accordance with the paper size of the recording material. (2) The speed at the time of the separation in the recording material holding means is controlled in accordance with the paper size of the recording material. (3) The separating speed of the recording material holding means is controlled in accordance with the number of recording materials which are held by the recording material holding means.

In addition to the above construction, it is preferable that the apparatus further has paper kind detecting means for discriminating the kind of the recording material and that three or more kinds of fixing speeds can be selected in accordance with a detection output of the paper kind detecting means. The operation unit is included in the paper kind detecting means.

According to the above construction of the invention, the speed in the recording material holding means is switched in correspondence to the fixing speed and the optimum control is executed in accordance with the size in the paper conveying direction of the recording material. Thus, an image can be formed by reducing the fixing speed at all of the paper sizes to which images can be formed without reducing a throughput of the image formation.

The above and other objects, features, and advantages of the present invention will become apparent from the following detailed description and the appended claims with reference to the accompanying drawings.

BRIEF DESCRIPTION OF THE DRAWINGS

FIG. 3 is a detailed control block diagram of an image processing section;

DETAILED DESCRIPTION OF THE PREFERRED EMBODIMENTS

An embodiment of the invention will now be described in detail hereinbelow with reference to the drawings.

Figure 1:
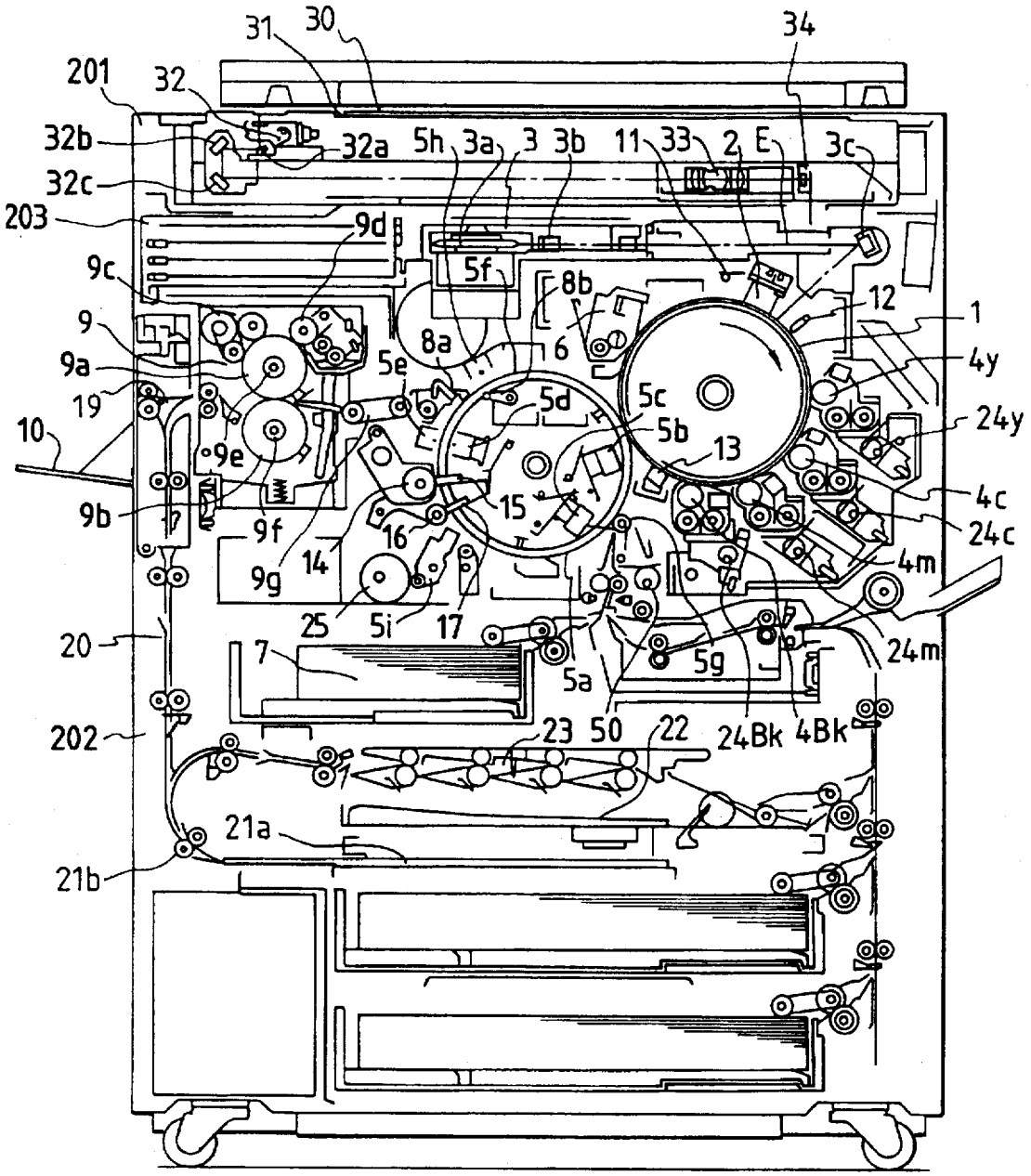
FIG. 1 is a schematic cross sectional view showing a color image forming apparatus in an embodiment of the invention.

FIG. 1 shows a schematic cross sectional view of a color image forming apparatus according to an embodiment of the invention. In the embodiment, a digital color image reader section 201 (hereinafter, simply abbreviated to a reader section) is provided in the upper portion. A digital color image printer section 202 (hereinafter, abbreviated to a printer section) is provided in the lower portion. An image processing section 203 is provided between the reader section 201 and the printer section 202.

In the reader section 201, an original 30 is put on an original supporting glass plate 31 and is exposed and scanned by an exposure lamp 32. Thus, a reflection light image from the original 30 is condensed by a lens 33 to a full color sensor 34 which is formed integrally with RGB 3-color separation filters, thereby obtaining color separation image analog signals. The color separation image analog signals pass through an amplifying circuit (not shown) and are converted to the digital signals. The digital signals are processed by the image processing section 203 and sent to the printer section 202.

In the printer section 202, a photosensitive drum 1 as an image holding member is rotatably supported in the direction shown by an arrow. A pre-exposure lamp 11, a corona charging unit 2, a laser exposure optical system 3, a potential sensor 12, a developing apparatus 4 (developing units 4y, 4c, 4m, 4Bk), a detecting sensor 13 of a light amount on the drum, a transfer apparatus 5, and a cleaning unit 6 are arranged around the photosensitive drum 1.

In the laser exposure optical system 3, the image signal from the reader section 201 is converted into the photosignal by a laser output section (not shown). The converted laser beam is reflected by a polygon mirror 3a and passes through a lens 3b and a mirror 3c and is projected to the surface of the photosensitive drum 1.

When an image is formed in the printer section 202, the photosensitive drum 1 is rotated in the direction shown by an arrow. After the photosensitive drum 1 was discharged by the pre-exposure lamp 11, the drum 1 is uniformly charged by the charging unit 2. A light image E is irradiated every separation color, thereby forming a latent image.

Subsequently, a predetermined developing unit is made operative and the latent image on the photosensitive drum 1 is developed, thereby forming a toner image mainly formed by a resin as a base material onto the photosensitive drum 1. The developing unit is allowed to alternatively approach the photosensitive drum 1 in accordance with each separation color by the operations of eccentric cams 24y, 24c, 24m, and 24Bk.

Further, the toner image developed on the photosensitive drum 1 is transferred to a recording material which was fed to the position which faces the drum 1 through from a recording material cassette 7 through a conveying system and the transfer apparatus 5. In the present embodiment, the transfer apparatus 5 comprises: a transfer drum 5a; a transfer charging unit 5b; an adsorption roller 5g which faces an adsorption charging unit 5c for electrostatically adsorbing the recording material; an inside charging unit 5d; and an outside charging unit 5e. A recording material holding sheet 5f made of a dielectric material is cylindrically integrally spread in the peripheral surface opening region of the transfer drum 5a which is axially supported so as to be rotated. As a recording material holding sheet 5f, a dielectric sheet such as a polycarbonate film or the like is used.

As the drum-shaped transfer apparatus, namely, the transfer drum 5a is rotated, the toner image on the photosensitive drum is transferred onto the recording material held on the recording material holding sheet 5f by the transfer charging unit 5b.

A desired number of color images are transferred onto the recording material that is adsorbed and conveyed to the recording material holding sheet 5f, thereby forming a full color image.

In case of forming a full color image, when the transfer of the toner images of four colors are finished as mentioned above, the recording material is separated from the transfer drum 5a by the operations of a separating nail 8a, a separation pushing-out roller 8b, and a separation charging unit 5h. The separated recording material is ejected onto a tray 10 through a thermal roller fixing unit 9.

On the other hand, the residual toner on the surface of the photosensitive drum 1 after completion of the transfer is cleaned by the cleaning unit 6. After that, the drum 1 is again used for the image forming step.

In case of forming images onto both sides of the recording material, after the recording material was ejected out of the fixing unit 9, a conveying path switching guide 19 is soon driven and the recording material is once led to a reversing path 21a through a conveying longitudinal path 20. After that, by the reverse rotation of a reversing roller 21b, the rear edge of the recording material fed is set to the head and the recording material is ejected in the direction opposite to the feeding direction and is enclosed onto an intermediate tray 22. After that, an image is again formed onto another surface by the foregoing image forming step.

In order to prevent that the powder is scattered and deposited onto the recording material holding sheet 5f of the transfer drum 5a and the oil is adhered onto the recording material and the like, they are cleaned by the functions of a fur brush 14, a backup brush 15 which faces the brush 14 through the recording material holding sheet 5f, an oil eliminating roller 16, and a backup brush 17 which faces the roller 16 through the sheet 5f. Such a cleaning operation is executed before or after the image formation and is performed each time a jam (paper jam) occurs.

In the embodiment, an eccentric cam 25 is made operative at a desired timing and a cam follower 5i which is integrated with the transfer drum 5a is made operative, thereby making it possible to arbitrarily set a gap between the recording material holding sheet 5f and the photosensitive drum 1. For example, a distance between the transfer drum and the photosensitive drum is increased during the standby mode or when the power source is turned off.

A toner density control in the developing apparatus 4 will now be described. By using characteristics such that each toner in the magenta developing unit 4m, cyan developing unit 4c, and yellow developing unit 4y is reflected for the near infrared light having a wavelength of about 960 nm, the reflection light is detected by a density detecting unit 780 of a developer arranged in each developing unit at the time of development. The detected reflection light is converted to the toner density signal by an A/D converter 752. The toner for the toner density signal is supplemented to the developing unit from a hopper (not shown).

On the other hand, since the black toner likewise absorbs the near infrared light having a wavelength of about 960 nm, the detection of the toner density in the developing unit is not executed. The near infrared light having a wavelength of about 960 nm is irradiated for the black toner image developed on the photosensitive drum 1. A density of the black toner developed is detected from a ratio between the reflected component on the photosensitive drum 1 and the absorbed component by the black toner, thereby calculating a toner density in the developing unit.

The sensor 13 to detect the light amount on the drum is arranged between the black developing unit 4Bk and the transfer charging unit 5b and can detect the black toner image developed by the black developing unit 4Bk before it is transferred. The sensor 13 can detect the black toner image in a state in which there is no toner density fluctuation by the transferring operation.

A thermal roller fixing unit 9 will now be described in detail. The thermal roller fixing unit 9 comprises: a fixing upper roller 9a; a fixing lower roller 9b; a fixing web 9c; and a fixing oil coating 9d.

The thermal roller fixing unit 9 melts the toner on the recording material by a heat energy of the fixing rollers (9a, 9b) and fixes the melted toner and the recording material by a pressure between the fixing rollers (9a, 9b). The surfaces of the fixing upper roller 9a and fixing lower roller 9b are controlled so as to be independently the optimum surface temperatures by a fixing upper heater 9e and a fixing lower heater 9f which are built in almost the central portions of those fixing rollers and a fixing upper thermistor 781 and a fixing lower thermistor 782 for detecting the roller surface temperatures.

The fixing web 9c is come into contact with the fixing upper roller as necessary in order to eliminate a dirt on the fixing upper roller 9a or the offset toner. In this instance, the new surface is come into contact with the fixing upper roller by a take-up apparatus built in the fixing web 9c, thereby also enabling the cleaning performance to be improved. The fixing oil coating 9d to supply a silicon oil to the cleaned surface is also prepared. The silicon oil is supplied to the fixing upper roller as necessary so that the toner on the recording material is not offset to the fixing upper roller 9a.

The thermal roller fixing unit 9 drives the fixing rollers (9a, 9b) and a recording material conveying section 9g by a fixing driving motor (not shown in FIG. 1). The fixing driving motor is driven by a fixing driving motor driver 761. In the embodiment, fixing speeds corresponding to three kinds of papers can be realized in order to eliminate a difference of fixing performance depending on the kind of recording material.

Specifically speaking, now assuming that a peripheral speed at the time of the image formation of the photosensitive drum 1 is set to $V_P$, a normal paper fixing speed $V_{FN}=V_P$. A fixing speed $V_{FT}$ for a thick paper is smaller than $V_{FN}$. A fixing speed $V_{FO}$ for an OHP is smaller than $V_{FT}$. Therefore, the relations of $V_P=V_{FN}>V_{PT}>V_{FO}$ are satisfied. The fixing driving motor driver 761 is constructed so that the above three kinds of fixing speeds can be realized. A conveying speed of the recording material conveying section 9g is equal to the peripheral speed of the fixing rollers (9a, 9b).

Figure 2:
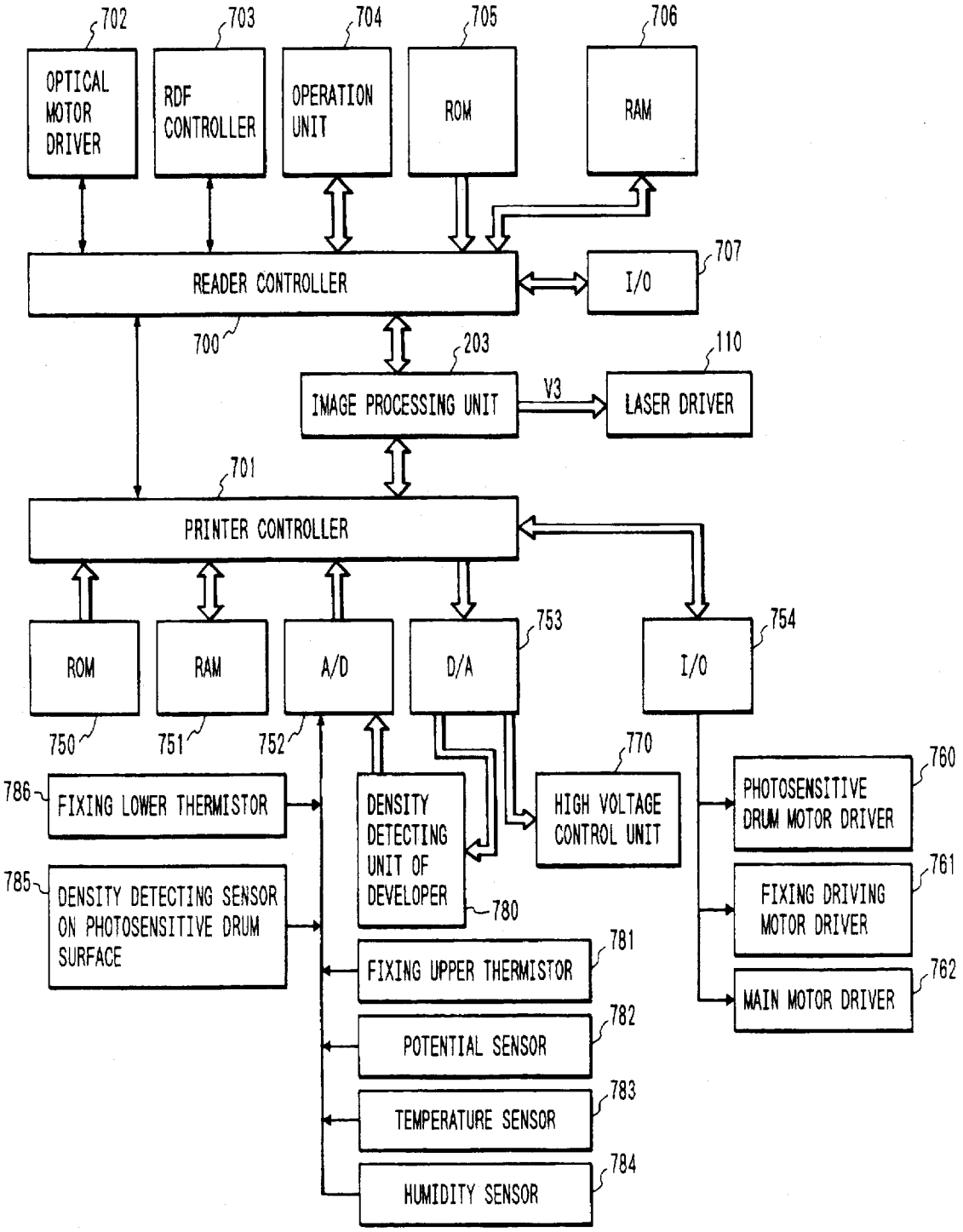
FIG. 2 is a control block diagram of the color image forming apparatus in the embodiment of the invention.

FIG. 2 is a control block diagram in the color image forming apparatus of an embodiment of the invention. The color image forming apparatus is largely divided into two blocks with respect to the control. One block mainly relates to the reader section 201 and a reader controller 700 to control the image processing section 203. Another block relates to a printer controller 701 to control the printer section 202.

Reference numeral 702 denotes an optical motor driver for driving an optical motor (not shown) to move scan mirrors (32a, 32b, 32c) and the exposure lamp 32; 703 indicates an RDF controller to control an automatic document feeder RDF to automatically exchange an original; 704 an operation unit to set the operating mode of the color image forming apparatus; 705 an ROM in which a control program of the reader controller 700 has been stored; 706 an RAM to store data such as control values and the like; and 707 an I/O to drive loads of the exposure lamp 32 and the like.

The RAM 706 is backed up by a battery so that it can hold the data even when a power source is cut off.

A peripheral control section of the printer controller 701 will now be described. Reference numeral 750 denotes an ROM to store the control program of the printer controller 701; 751 an RAM to store the data such as control values and the like; 752 the A/D converter to convert the analog signals from the potential sensor 12, detecting sensor 13 of the light amount on the drum, and the like to the digital data; 753 a D/A converter for outputting the analog set values to a high voltage control section 770 and the like; and 754 an I/O to drive loads of a motor, a clutch, and the like.

FIG. 3 is a block diagram showing an example of a construction of the image processing section 203 according to the embodiment. In FIG. 3, reference numeral 101 denotes a CCD reading unit comprising: amplifiers for amplifying the analog RGB signal, inputted from the full color sensor 34; A/D converters for converting the analog RGB signals to the digital signals of, for example, eight bits; shading correction circuits for performing the well-known shading correction; and the like. The CCD reading unit 101 generates the digital RGB image signals of the original image.

Reference numeral 102 denotes a shift memory for correcting, for example, a deviation between the colors and a deviation between the pixels of the RGB image signals inputted from the CCD reading unit 101 in accordance with a shift amount control signal from the reader controller 700. Reference numeral 103 denotes a complementary color conversion circuit for converting the RGB image signals inputted from the shift memory 102 to MCY image signals.

Reference numeral 104 denotes a black extracting circuit for extracting a black region of the image from the MCY image signals inputted from the complementary color conversion circuit 103 in accordance with the black extraction signal inputted from the reader controller 700, and for outputting a Bk image signal for the extracted black region.

Reference numeral 105 denotes a UCR circuit for performing an undercolor removing (UCR) process to the MCY image signals inputted from the complementary color conversion circuit 103 in accordance with the Bk image signal inputted from the black extracting circuit 104 and a UCR amount control signal inputted from the reader controller 700.

That is, the black extracting circuit 104 and UCR circuit 105 don't overlap the extracted black region to the toners of three colors of MCY but replace it to the Bk toner and execute an image formation, thereby improving the color reproducibility.

The Bk image signal which is extracted from the black extracting circuit 104 is determined by the following equation (1).

$$Bk=A\cdot\min(C2, Y2, M2) \quad (1)$$

In the equation (1), (A) denotes a black extraction coefficient and C2, Y2, and M2 indicate MCY image signals outputted from the complementary color conversion circuit 103. The black extraction coefficient (A) is determined by a black extraction amount control signal which is designated from the reader controller 700.

The MCY image signals which are outputted from the UCR circuit 105 are determined by the following equations (2).

$$M1=B1\cdot(M2-D1\cdot Bk)$$

$$C1=B2\cdot(C2-D2\cdot Bk)$$

$$Y1=B3\cdot(Y2-D3\cdot Bk) \quad (2)$$

In the equation (2), M2, C2, and Y2 denote the MCY image signals generated from the complementary color correction circuit; M1, C1, and Y1 indicate MCY image signals which are generated from the UCR circuit 105; and coefficients B1, B2, B3, D1, D2, and D3 are decided by a UCR amount control signal from the reader controller 700.

Reference numeral 106 denotes a masking circuit for performing a masking process to the MCY image signals inputted from the UCR circuit 105 in accordance with a masking coefficient control signal inputted from the reader controller 700 in order to eliminate the turbidity component of the toner which is used and to correct the RGB filter characteristics of the CCD. MCY image signals which are outputted from the masking circuit 106 are expressed by the following equation (3).

$$\begin{bmatrix} M0 \\ C0 \\ Y0 \end{bmatrix} = \begin{bmatrix} a11 & a12 & a13 \\ a21 & a22 & a23 \\ a31 & a32 & a33 \end{bmatrix} \begin{bmatrix} M1 \\ C1 \\ Y1 \end{bmatrix} \quad (3)$$

In the equation (3), all to a33 denote masking coefficients; M1, C1, and Y1 indicate the MCY image signals generated from the UCR circuit 105; M0, C0, and Y0 indicate MCY image signals which are generated from the masking circuit 106; and the masking coefficients all to a33 are determined by a masking coefficient control signal that is designated from the reader controller 700.

Reference numeral 107 denotes a selector for selecting the image signal of one color from the MCYBk image signals inputted from the masking circuit 106 and black extracting circuit 104 in accordance with a color selection signal inputted to a selection terminal S from the reader controller 700, thereby outputting an image signal V1.

Figure 4:
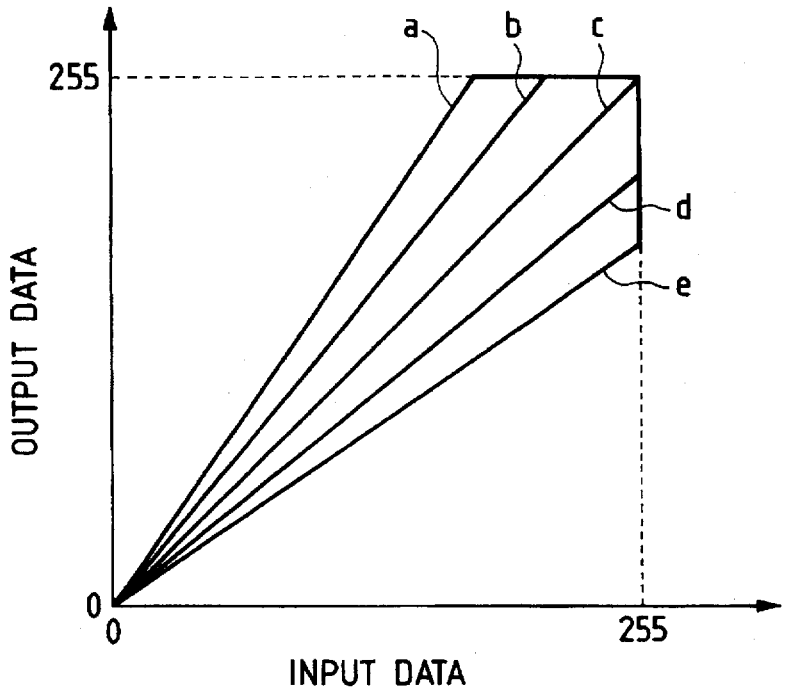
FIG. 4 is a tone correcting characteristics diagram showing an example of input/output signals in a reader tone correction circuit.

Reference numeral 108 denotes a reader tone correction circuit for performing a tone correction as shown in FIG. 4 to the image signal V1 inputted from the selector 107, thereby outputting an image signal V2. For example, the reader tone correction circuit 108 performs a density correction to the image signal on the basis of either one of converting characteristics (a to e) shown in FIG. 4 as an example which is selected by a tone correction selection signal designated from the reader controller 700. The setting in the reader tone correction circuit is decided by the setting of an image density of an operation unit, which will be explained hereinlater.

Figure 5:
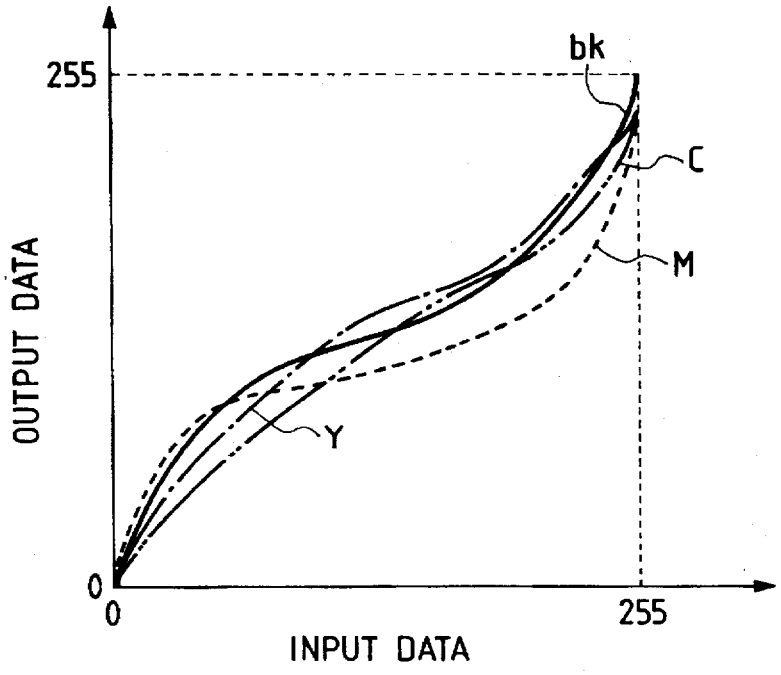
FIG. 5 is a tone correcting characteristics diagram showing an example of input/output signals in a printer tone correction circuit.

Reference numeral 109 denotes a printer tone correction circuit for selecting either one of gamma characteristics (m, c, y, bk) shown in FIG. 5 as an example in accordance with a printer color selection signal inputted from the printer controller 701 in order to make the output characteristics of the printer section 202 linear every color, thereby performing the correction to the image signal.

Reference numeral 110 denotes a laser driver included in the laser exposure optical system 3. The laser driver 110 modulates a semiconductor laser on the basis of an image signal V3 inputted from the printer tone correction circuit 109, thereby forming a latent image onto the photosensitive drum 1.

Figure 6:
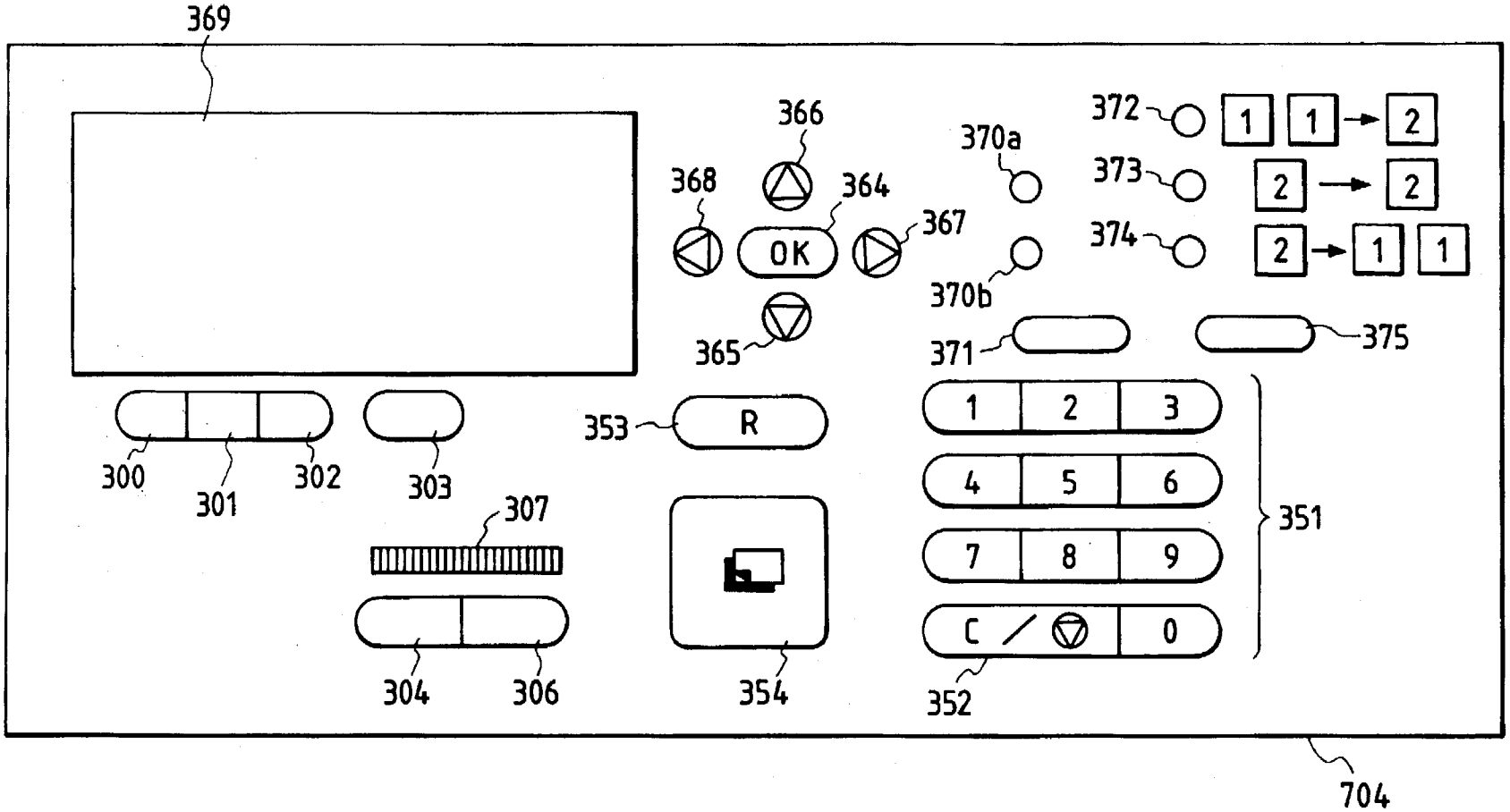
FIG. 6 is a schematic diagram of an operation unit of a color image forming apparatus in the embodiment of the invention.

FIG. 6 shows an operation unit of the color image forming apparatus in the embodiment. In FIG. 6, reference numeral 351 denotes a ten-key which is used for inputting numerical values to set the number of images to be formed and to set the mode; 352 a clear/stop key for clearing the set number of images to be formed and for stopping the image formation operation; 353 a reset key for resetting the number of images to be formed, the operation mode, and the mode of a selection feed paper stage or the like to the specified values; and 354 a start key to start the image formation operation by being depressed.

Reference numeral 369 denotes a display panel which is constructed by a liquid crystal or the like for making the detailed mode setting easy. The display contents of the display panel 369 are changed in accordance with the setting mode. In the embodiment, a cursor on the display panel 369 is moved by cursor keys 366 to 368 and the setting is determined by an OK key 364. Such a setting method can be also constructed by a touch panel.

Reference numeral 371 denotes a paper kind setting key which is set when an image is formed onto a recording material that is thicker than a normal paper. When the paper kind setting key 371 is depressed once, a thick paper mode is set and an LED **370*a* is lit on. By further depressing once the paper kind setting key 371, an OHP mode is set, the LED 370*a* is lit off, and an LED 370*b* is lit on. By further depressing the paper kind setting key 371 once more, the operating mode is returned to a normal paper mode and the LEDs 370*a* and 370*b*** are lit off.

Reference numeral 375 denotes a both-sides mode setting key which can set the following four kinds of both-sides modes: namely, a one-side/one-side mode for performing a one-side output from, for example, a one-side original; a one-side/both sides mode for performing a both-sides output from a one-side original; a both-sides/both-sides mode for performing a both-sides output from a both-sides original; and a both-side/one-side mode for performing two one-side outputs from a both-sides original. LEDs 372 to 374 are lit on in accordance with the set both-sides mode. In the one-side/one-side mode, all of the LEDs 372 to 374 are lit off. In the one-side/both-sides mode, only the LED 372 is lit on. In the both-sides/both-sides mode, only the LED 373 is lit on. In the both-sides/one-side mode, only the LED 374 is lit on.

The 4-color operation in case of the normal paper when the automatic document feeder RDF is not used and the mode for thick paper is not set in the one-side/one-side mode will now be described hereinbelow as a specific example.

In this case, since the normal paper is used as a recording material to form an image, a speed for the fixing driving motor driver 761 is set to $V_{FN}$ that is equal to the image formation speed $V_P$ of the photosensitive drum 1.

After the number of images to be formed was set by using the ten-key 351, when the operator selects the paper feed stage by a paper selection key 303 and instructs the operation start by the start key 354, the printer controller 701 instructs the driving to each driver of the driving motors which are necessary to form the image, for example, the photosensitive drum driving motor, fixing driving motor, paper feed driving motor, and main driving motor.

After the driving states of the motors were stabilized, the paper feeding operation of the recording material P is started from the designated paper feed stage. In this instance, the reader section 201 sets the foregoing shift amount, black extraction amount, UCR amount, reader color selection signal, and the like into each block of the image processing section 203 so that the image signal for magenta as a development color of the first color in the 4-color mode can be produced. As for the reader tone correction circuit 108, either one of the converting characteristics (a to e) shown in FIG. 4 corresponding to the designation contents of density keys 304 and 306 of the operation unit 704. The converting characteristics (m) shown in FIG. 5 are selected for the printer tone correction circuit 109.

A feeding timing of the recording material P fed from the designated paper feed stage is matched with the optical scanning operation of the reader section 201 by a resist roller 50. The recording material P is subsequently adsorbed to a transfer sheet (recording material holding sheet **5*f*) by the adsorption roller 5*g* as an electrode which faces the adsorption charging unit 5*c***.

The original information read by the reader section 201 is processed by the image processing section 203 and is irradiated as a laser beam onto the photosensitive drum 1 which was uniformly charged by the corona charging unit 2, so that a latent image is formed and developed by the magenta developing unit **4*m*. The developed image information is transferred to the transfer charging unit 5*b* onto the adsorbed recording material P by the transfer charging unit 5*b*. The above image formation operations for reading the original, forming the latent image, developing, and transferring are executed to each of the remaining three colors C (cyan), Y (yellow), and Bk (black) in accordance with this order. It is now assumed that the setting operations to the image processing section 203** are executed every image formation.

In order to separate the recording material P onto which the images of four colors were transferred from the transfer sheet **5*f*, an adsorbing force between the transfer sheet 5*f* and the recording material P is weakened by the separation charging unit 5*h*. The transfer sheet 5*f* is deformed by the separation pushing-up roller 8*b* and a curvature separation is executed. The recording material P is separated from the transfer sheet 5*f* by the separating nail 8*a***.

The recording material P separated as mentioned above is conveyed to the thermal roller fixing unit 9 by the recording material conveying section **9*g* for conveying at the same speed ($V_P$) as the transfer drum 5*a* and is fixed at the fixing speed $V_{FN}=V_P$ and is ejected out onto the tray 10**.

The control of the image formation operation in the thick paper mode as a main object of the present embodiment will now be described in detail. Since the control in the OHP mode is substantially similar to that in the thick paper mode except a point that $V_{FT}$ is changed to $V_{FO}$, the case of the thick paper mode will now be described as an example hereinbelow.

Since an energy larger than that in case of the normal paper is needed to fix the toner on the thick paper, by setting the fixing speed to be slower than that in case of the normal paper as mentioned above, the energy per unit area and per unit time is increased, thereby assuring the fixing performance of the thick paper. In the conventional method in this instance, the distances from the separating nail **8*a* to the contact positions of the upper and lower fixing rollers are set to be larger than the maximum size at which the image can be formed on the thick paper, thereby making constant the peripheral speed of the transfer drum 5*a* as an image (latent image) formation speed $V_P$ and setting the recording material conveying section 9*g* to the speed converting region for obtaining the fixing speed $V_F$ different from the speed of the transfer drum 5*a*. Therefore, the recording material conveying section 9*g*** has to be assured by an area corresponding to only the maximum size at which the image can be formed on the thick paper. There is, consequently, a drawback such that the apparatus increases in size.

The embodiment, therefore, is constructed so that the speed of the transfer drum **5*a* can be varied in a manner similar to the fixing speed. When the fixing speed $V_F$ has to be made slower than the image formation speed $V_P$, the recording material is not soon separated after the final color transfer but the transfer drum 5*a*** is again rotated once. After that, the separating operation is executed, thereby preventing an increase in size of the apparatus.

Figure 7:
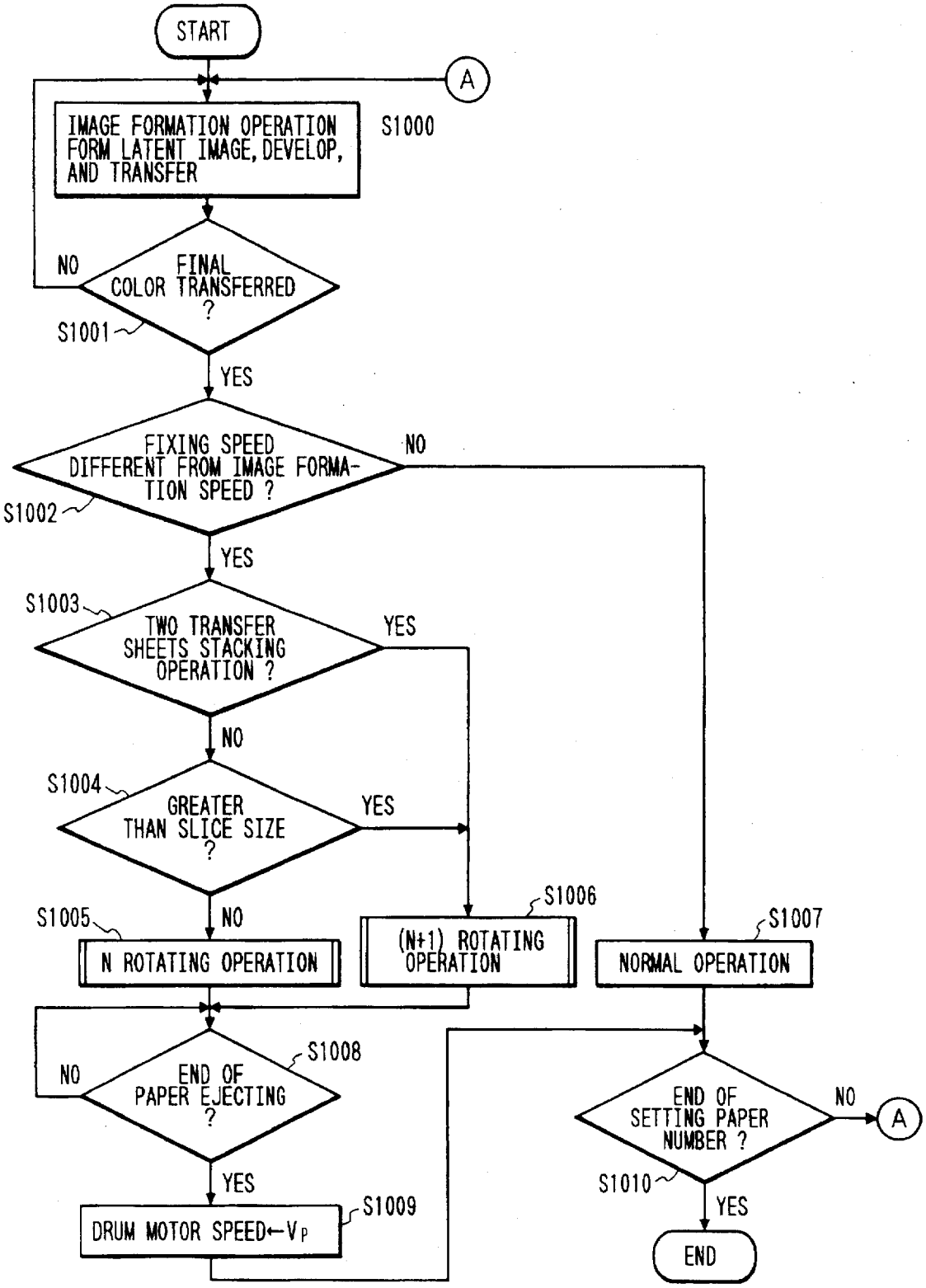
FIG. 7 is a flowchart showing a fixing control in the embodiment of the invention.

The image formation control in the 4-color mode/thick paper mode will now be described hereinbelow with reference to a flowchart shown in FIG. 7.

As mentioned above, the operations for forming the latent image, developing, and transferring (S1000) including the paper feed and the adsorption are repeated until the final color is transferred (S1001). In the thick paper mode, since the fixing speed $V_F=V_{FT}$ and differs from the image formation speed $V_P$, the processing routine advances to step S1003.

For the transfer sheet **5*f*, a check is made to see if the operating mode is a mode in which a plurality of recording materials are held or not (S1003). In the embodiment, since the electrostatic adsorption is used as recording material holding means, in case of the recording material of the size that is equal to or less than ½ of the whole periphery of the transfer sheet 5*f*, images can be simultaneously formed on two recording papers. In the fixing control, in case of simultaneously forming images onto two recording materials (hereinafter, such a case is referred to as a two transfer sheets stacking operation), the two recording materials are handled as one recording material including the distance between the two recording materials and an (N+1) rotating control, which will be explained hereinlater, is executed (S1003**).

In case of holding only one recording material to the transfer sheet **5*f* and performing the image formation operation, a distance $L_{TC}$ from the transfer position to the edge position of the recording material conveying section 9*g* is compared with a size PX in the paper conveying direction of the recording material (S1004**).

When the size PX is larger than the distance $L_{TC}$, the distance from the transfer position to the edge position of the recording material conveying section **9*g* cannot be used in the converting region of the fixing speed. Therefore, an (N+1) rotating operation, which will be explained hereinlater, is executed (S1006**).

On the contrary, when the size PX is smaller than the distance $L_{TC}$, an N rotating control, which will be explained hereinlater, is performed (S1005). After that, the apparatus waits for the end of the fixing and the end of the paper ejection (S1008), as a speed of the transfer drum 5a, the speed of the drum motor is set to $V_P$ for the image formation to the next recording material (S1009).

The above operations are executed the number of times corresponding to the set number (S1010). After completion of the operations by the set number of times, the image formation operation is finished.

Figure 8:
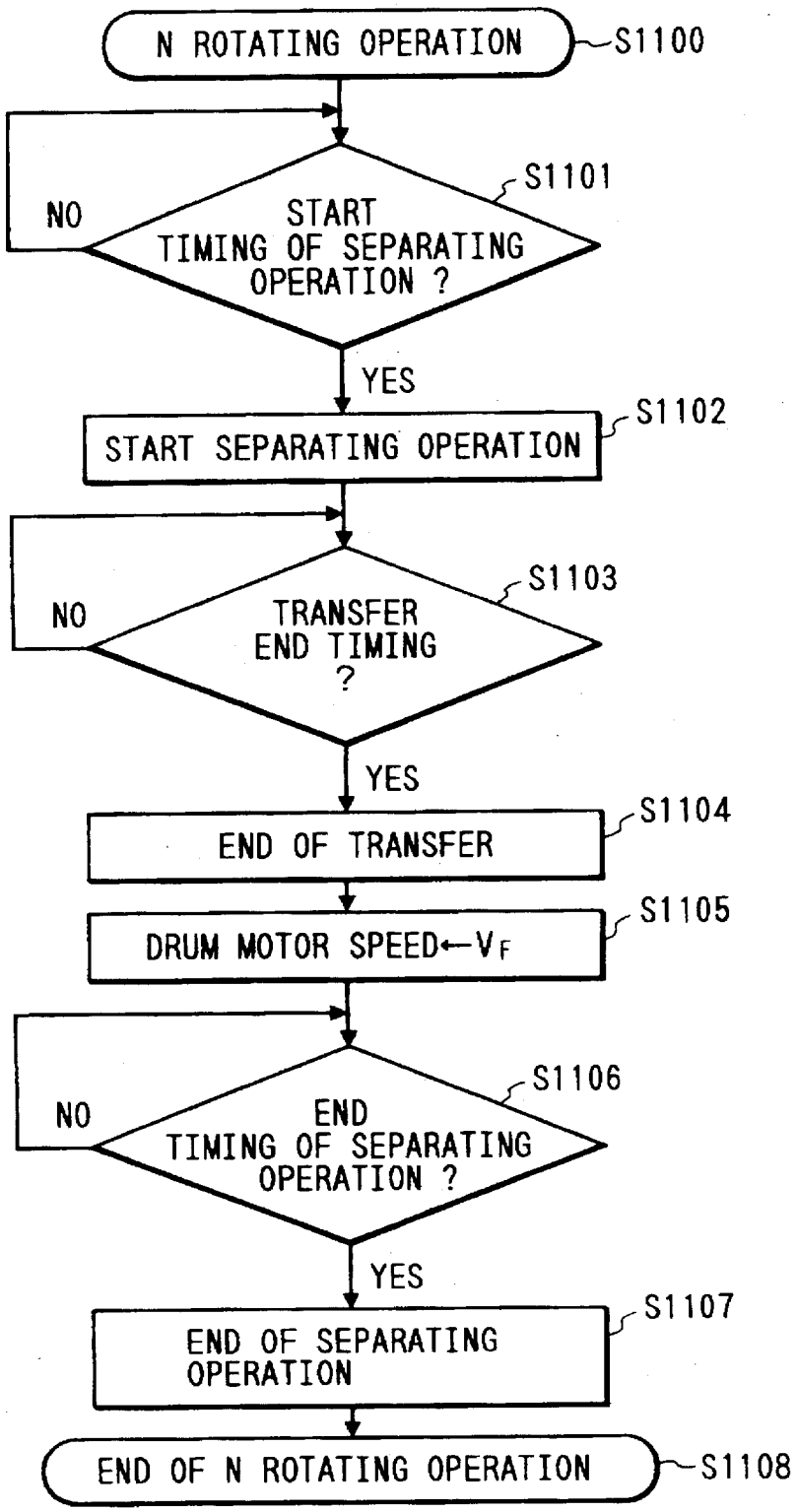
FIG. 8 is a flowchart showing an N rotating control of the fixing control in the embodiment of the invention.
Figure 9:
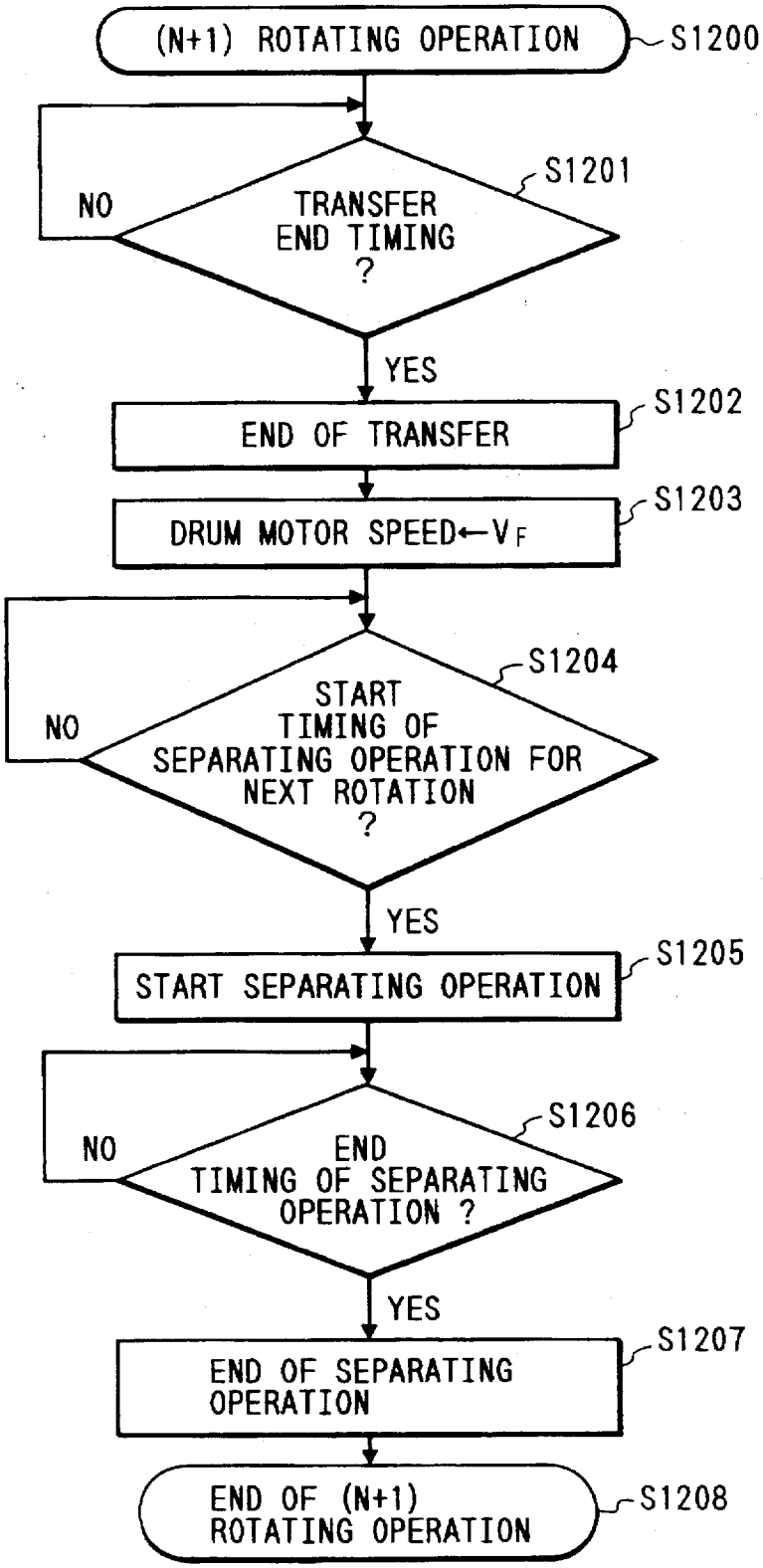
FIG. 9 is a flowchart showing an (N+1) rotating control of the fixing control in the embodiment of the invention.

The N rotating control and the (N+1) rotating control in the fixing control will now be described with reference to flowcharts shown in FIGS. 8 and 9 and timing charts shown in FIGS. 10 to 13. For simplicity of explanation, it is assumed that the distance $L_{TC}$ from the transfer position to the edge position of the recording material conveying section 9g in the embodiment shown in FIG. 1 is equal to 300 mm.

The controls by the representative recording material sizes in the thick paper mode are shown below.

(1) A4 lateral feeding size (feeding direction: 210 mm), one transfer sheet stacking: N rotating control
(2) A4 longitudinal feeding size (feeding direction: 297 mm), one transfer sheet stacking: N rotating control
(3) A3 lateral feeding size (feeding direction: 420 mm), one transfer sheet stacking: (N+1) rotating control
(4) A4 lateral feeding size (feeding direction: 210 mm), two transfer sheets stacking: (N+1) rotating control First, the N rotating control in the thick paper mode will be described with reference to a flowchart of FIG. 8 and timing charts of FIGS. 12 and 13.

Figure 12:
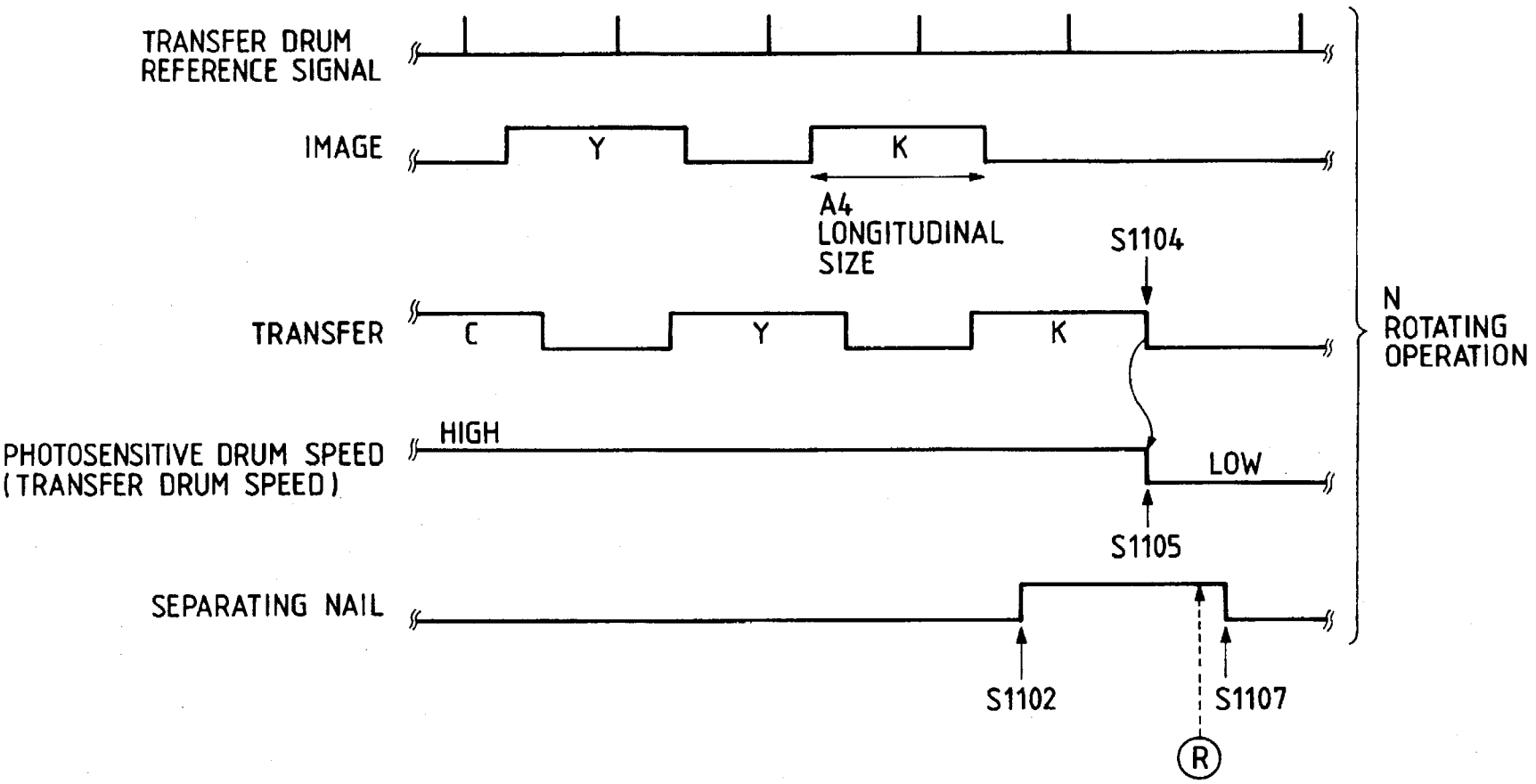
FIG. 12 is a timing chart showing the (N+1) rotating control of an A4 longitudinal size fixing control in the embodiment of the invention.
Figure 13:
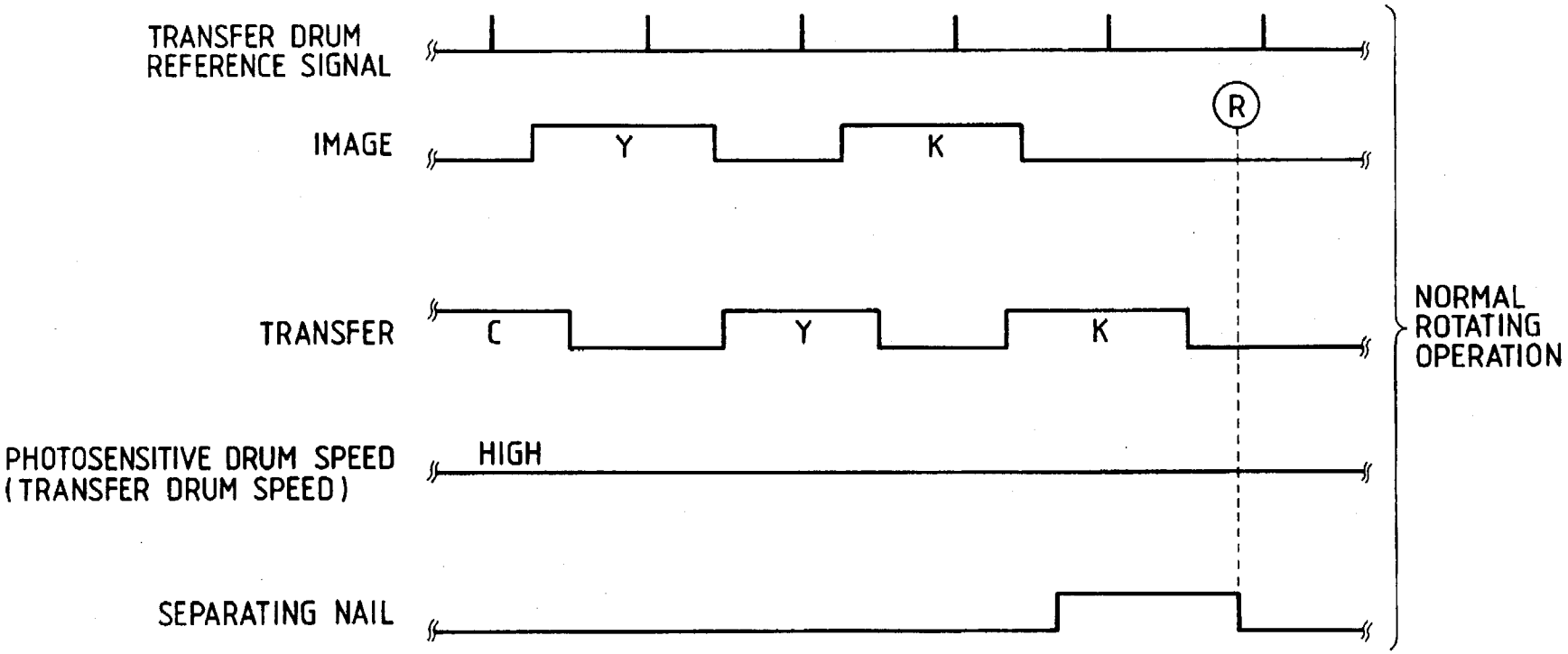
FIG. 13 is a timing chart showing a normal control of the A4 longitudinal size fixing control in the embodiment of the invention.

The timing charts of FIGS. 12 and 13 are expressed by the A4 longitudinal feeding size of the recording material size. FIG. 12 shows the N rotating control in the thick paper mode. FIG. 13 shows the normal control instead of the thick paper mode.

Even when the peripheral speed of the transfer drum that is equal to the image formation speed $V_P$ is set to the fixing speed $V_F$ at the end of the transfer operation, since the front edge of the recording material doesn't reach the front edge of the recording material conveying section 9g, the N rotating control uses a fact that there is no problem on the conveyance of the recording material.

The flowchart of FIG. 8 will now be described hereinbelow.

In the N rotating control, the operation is started at the start of the final color transfer. The separating operation is substantially the same as the normal rotating control instead of the thick paper mode. Therefore, the apparatus waits for the timing to start the separating operation (S1101). When the separation start timing comes, the separating nail 8a and separation pushing-out roller 8b are made operative and the separating operation is started (S1102).

The apparatus subsequently waits until the transfer end timing that is decided from the size PX in the recording material conveying direction comes (S1103). When the transfer end timing comes, an output of the transfer charging unit is set to OFF (S1104). For a photosensitive drum motor driver 760, the speed is set so as to equalize the peripheral speed of the transfer drum with the fixing speed $V_{FT}$ for the thick paper (S1105). After that, the apparatus waits until the separating operation end timing comes, the separating nail 8a is turned off, and the separating operation is finished (S1107).

Thus, the peripheral speed of the transfer speed 5a is equal to the fixing speed (=speed of the recording material conveying section) before the front edge of the recording material reaches the recording material conveying section 9g that is driven at the same speed as the fixing speed. Therefore the recording material is normally separated and conveyed and is fixed at the fixing speed for the thick paper.

The (N+1) rotating control will now be described with reference to a flowchart of FIG. 9 and timing charts of FIGS. 10 and 11.

Figure 10:
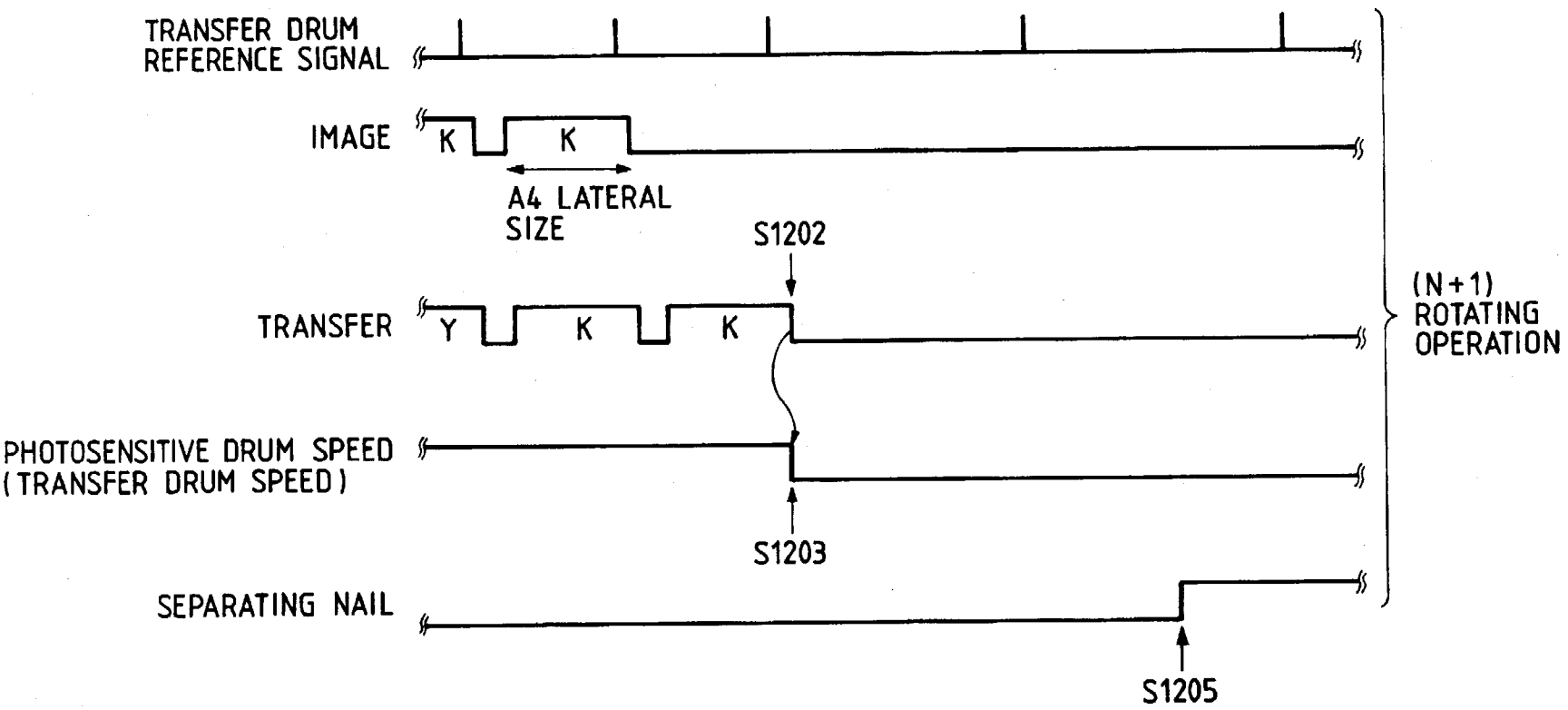
FIG. 10 is a timing chart showing the (N+1) rotating control of an A4 lateral size fixing control in the embodiment of the invention.
Figure 11:
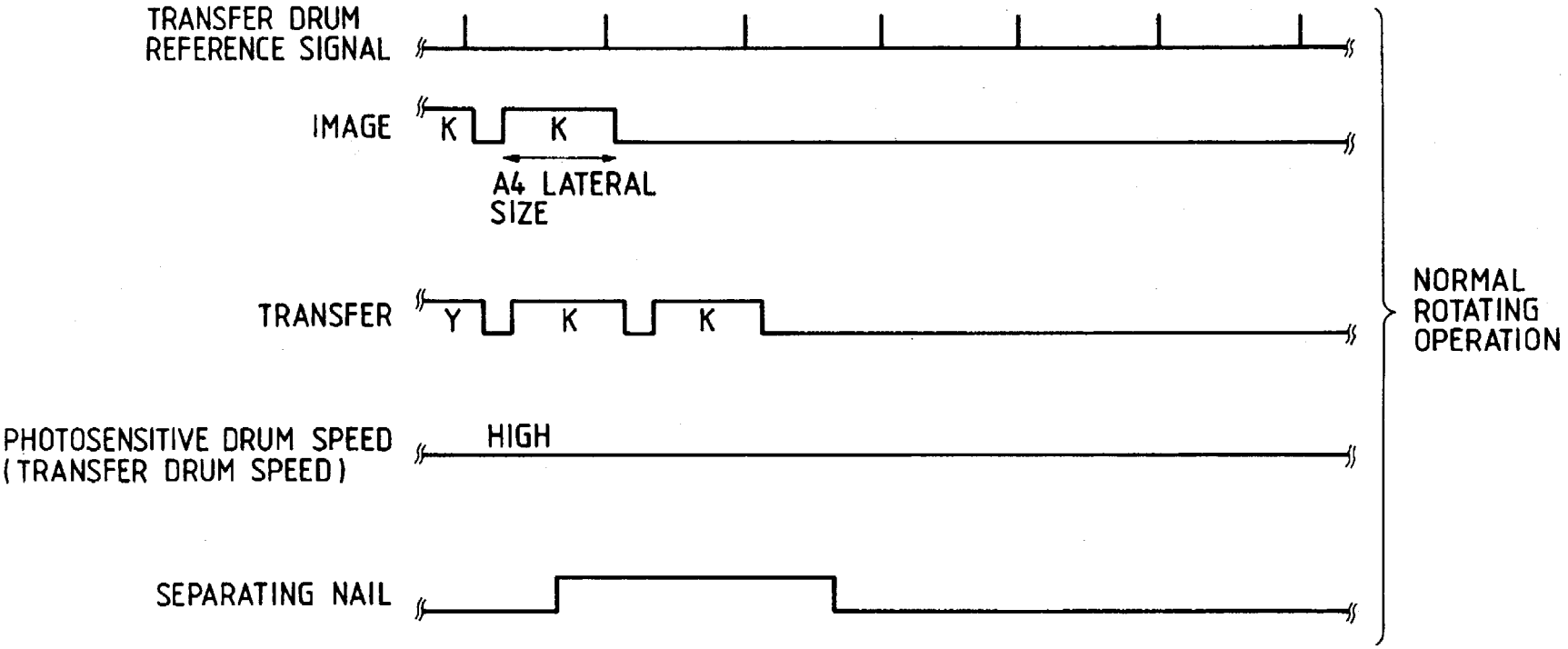
FIG. 11 is a timing chart showing a normal control of the A4 lateral size fixing control in the embodiment of the invention.

The timing charts of FIGS. 10 and 11 are expressed with respect to the two transfer sheets stacking of the A4 lateral feeding size. FIG. 10 expresses the timing chart of the (N+1) rotating control. FIG. 11 expresses the timing chart of the normal rotating operation instead of the thick paper mode.

In the (N+1) rotating control, an idea such that both papers and the portion between them are set to one paper as mentioned above is applied to the two transfer sheets stacking of the A4 lateral feeding size. When considering the two-transfer sheets stacked paper as one paper, since the distance $L_{TC}$ from the transfer position to the edge of the recording material conveying section is larger than 300 mm, the distance between them cannot be used as a speed converting region of the fixing speed. Therefore, the transfer operation and the separating operation are not almost simultaneously executed as in case of the normal rotating operation instead of the N rotating control or the thick paper mode but, even after completion of the transfer operation, the separating operation is not executed but is performed after the transfer drum 5a rotated once.

Thus, the whole transfer drum 5a is used as a speed converting region.

The control will now be described hereinbelow with reference to the flowchart of FIG. 9.

The apparatus waits for the end of the transfer of the final color (S1201). When the transfer end timing comes, a high voltage of the transfer charging unit is turned off and the transfer operation is finished (S1202).

The peripheral speed of the transfer drum 5a is set so as to be equal to the fixing speed $V_{FT}$ (S1203). At this speed, the apparatus waits until the separation start timing in the next rotation comes (S1204). When the separation start timing comes, the separating operation is executed (S1205). After completion of the separating operation (S1206), the separating nail 8a is turned off (S1207). The operation is finished.

Thus, the transfer drum 5a is set to the speed converting region. The operation in the thick paper mode can be performed up to the image formation maximum size of the normal operation, In the two transfer sheets stacking operation, the thick paper mode can be also realized.

Namely, although the above embodiment has been shown and described with respect to the case of switching the fixing speed to three stages as an example, the fixing speed can be also switched to two stages or to four or more stages.

Although the above embodiment has been shown as an example with respect to the case where the recording material conveying section 9g has been set to the same conveying speed as the fixing speed, it can be also set to the same speed as the peripheral speed of the transfer drum 5a. In such a case, the objects of the invention can be also accomplished.

In this case, the distance $L_{TC}$ which is compared with the size PX in the paper conveying direction of the recording material in the first embodiment is replaced to the distance $L_{TF}$ from the transfer position to the fixing roller, thereby enabling the invention to be realized.

Although the first embodiment has been shown with respect to the case of the 4-color mode/thick paper mode, the invention can be also realized even in case of 1-color, 2-color, 3-color mode/thick paper mode.

In such a case, particularly, so long as an image in which a fixing performance is assured can be outputted even if the fixing speed is not reduced in case of the 1-color mode/thick paper mode in which it is sufficient that the unit time heat energy which is supplied to the recording material is relatively small, it is also possible not to reduce the fixing speed in the 1-color mode.

Although the adsorbing means has been used as recording material holding means in the above embodiment, it can be also constructed by well-known gripper means.

Although the embodiment has been described above with respect to the color copying apparatus, the invention is not always limited to the color image but the invention can be also applied to a copying apparatus or an electrophotographic printer of a single color, two colors, or three colors.

In case of the electrophotographic printer, a circuit or the like (RIP) for converting a printer describing language which is outputted from the host computer to a writer image is provided in place of the reader section 201.

According to the invention as described above, a mode for performing the fixing operation at the fixing speed different from the image formation speed in the thick paper mode or the like can be realized without an increase in size of the apparatus or a limitation of the image forming size.

What is claimed is:

1. An image forming apparatus comprising:

recording material holding means for holding a recording material to record image information;

means for switching and setting a plurality of fixing speeds; and separating means for separating said recording material from said recording material holding means at a speed corresponding to said fixing speed set, wherein a separation timing of the separating means, at the time of separating the recording material from said recording material holding means, is controlled in accordance with a paper size of said recording material.

2. An apparatus according to claim 1, wherein said separating means controls a speed at the time of the separation in said recording material holding means.

3. An apparatus according to claim 2, wherein a speed at the time of the separation in said recording material holding means is controlled in accordance with a paper size of said recording material.

4. An apparatus according to claim 2, wherein a separating speed of said recording material holding means is controlled in accordance with the number of recording materials which are held in said recording material holding means.

5. An apparatus according to claim 1, further comprising paper kind detecting means for discriminating the kind of said recording material, and wherein three or more kinds of fixing speeds can be selected in accordance with a detection output of said paper kind detecting means.

6. An apparatus according to claim 5, wherein said paper kind detecting means includes an operation unit.

7. An apparatus according to claim 1, further comprising means for recording images of a plurality of color components onto the recording material held in said recording material holding means.

8. An apparatus according to claim 7, wherein said recording means includes:

means for sequentially overlaying the images of said plurality of color components onto a photosensitive drum, thereby forming an image; and means for transferring the image formed onto the recording material.

9. An apparatus according to claim 1, further comprising means for reading an original image.

10. An image forming apparatus, comprising:

a recording-medium carrying member rotating at a first speed while carrying a recording medium onto which an image is formed;

fixing means for fixing the image on the recording medium, said fixing means being capable of performing a fixing operation at one of at least a first and a second fixing speeds; and control means for controlling an operation of said apparatus in one of a first and a second operation modes, wherein, in a first operation, the recording medium is separated from said recording-medium carrying member rotating at the first speed and is fixed by said fixing means at a first fixing speed, and in a second operation mode, said recording-medium carrying member is rotated at least one more rotation than in the first operation mode, and after a rotational speed is changed from the first speed to a second speed during said at least one rotation, the recording medium is separated from said recording-medium carrying member and is fixed by said fixing means at the second fixing speed.

11. An apparatus according to claim 10, further comprising:

means for forming an image onto a photosensitive drum; and means for transferring the image formed on said photosensitive drum to the recording medium on said recording medium carrying member.

12. An apparatus according to claim 10, wherein one color component image is formed on the recording medium for each rotation of said recording-medium carrying member.

13. An apparatus according to claim 12, further comprising means for selectively setting one of a plurality of modes associated with the recording medium in accordance with an instructive operation of an operator.

14. An apparatus according to claim 13, further comprising means for selecting one of at least the first and second operation modes in accordance with the mode set by said setting means.

15. An apparatus according to claim 10, further comprising means for selecting one of at least the first and second modes in accordance with the number of color components of an image to be image-formed.

16. An apparatus according to claim 14, wherein the plurality of modes includes a normal mode and at least one of a thick paper and an OHP modes.

17. An apparatus according to claim 12, wherein said control means further controls the operation of said apparatus in a third operation mode where the recording medium is separated from said recording-medium carrying member and is fixed by said fixing means at the second fixing speed without more rotating said recording-medium carrying member which holds the recording medium than the operation in the first operation mode after the change of the first speed to the second speed.

18. An apparatus according to claim 19, wherein the plurality of modes includes a normal mode and at least one of a thick paper and an OHP modes, and said predetermined mode is at least one of the thick paper and OHP modes.

19. An apparatus according to claim 18, further comprising means for selecting one of the second and third operation modes when one of the thick paper and OHP modes is set by said setting means.

20. An apparatus according to claim 19, wherein one of the second and third operation modes is selected in accordance with a size of the image which is formed during one rotation of said recording-medium carrying member.

21. An image forming apparatus comprising:

means for forming an image onto a recording medium at an image forming position;

means for feeding a recording medium to the image forming position, said feeding means capable of feeding a recording medium cyclically; and means for fixing the image formed on the recording medium, wherein said apparatus has a first mode, in which a recording medium, on which an image is formed, is refed to the image forming position without forming an image thereon at the image forming position and has a feeding speed which is changed during the refeeding, so that the recording medium is supplied to the fixing means at a first speed corresponding to the changed feeding speed.

22. An image forming apparatus according to claim 21, wherein said feeding means comprises a drum-shaped recording-medium carrying member.

23. An image forming apparatus according to claim 21, wherein said image forming means comprises means for forming an image on an image bearing member and a means for transferring the image on the image bearing member to a recording medium.

24. An image forming apparatus according to claim 21, further comprising at least one of original reading means and interface means for receiving data from an external device, wherein said image forming means forms an image corresponding to an image signal from said original reading means or said interface means.

25. An image forming apparatus according to claim 22, wherein said apparatus has a second mode, in which a feeding speed is changed after an image formation on a recording medium without refeeding the recording medium to the image forming position, so that the recording medium is supplied to the fixing means at a first speed corresponding to the changed feeding speed, and comprises means for selecting one of the first and second modes in accordance with a size of an image formed during one rotation of said drum-shaped recording-medium carrying member.

26. An image forming apparatus according to claim 21, wherein said apparatus has a third mode, in which a recording medium, on which an image is formed, is supplied to the fixing means at a second speed corresponding to the feeding speed during the image formation.

27. An image forming apparatus according to claim 25, wherein said apparatus has a plurality of modes relating to a recording medium and including a normal paper mode, and the third mode is selected when the normal paper mode is set.

28. An image forming apparatus according to claim 21, wherein the plurality of modes relating to a recording medium includes at least one of a thick paper and OHP sheet modes.

29. An image forming apparatus according to claim 21, wherein said apparatus is capable of forming a color image.

30. An image forming apparatus according to claim 21, wherein the third mode is selected when a mon-color image is formed in the thick paper or OHP sheet mode.

* * * * *

UNITED STATES PATENT AND TRADEMARK OFFICE

CERTIFICATE OF CORRECTION

PATENT NO. : 5,689,760

DATED : November 18, 1997

INVENTORS : Akio Suzuki, et al.

It is certified that error appears in the above-identified patent and that said Letters Patent is hereby corrected as shown below:

COLUMN 4

Line 7, "through" should be deleted.

COLUMN 5

Line 48, "a" should be deleted.

COLUMN 14

Line 15, "operation," should read --operation mode,--;
Line 56, "more" should be deleted;
Line 57, "than" should read --more than--; and
Line 64, "claim 18," should read --claim 9,--.

COLUMN 16

Line 30, "mon-color" should read --non-color--.

Signed and Sealed this

Twenty-sixth Day of May, 1998

Bruce Lehman

*Attest:*

BRUCE LEHMAN

*Attesting Officer*

*Commissioner of Patents and Trademarks*